United States Patent [19]

Vaughn

[11] 4,114,303

[45] Sep. 19, 1978

[54] MUZZLE LOADING FIREARM

[76] Inventor: James C. Vaughn, Rte. 4, Box 348-D, Madison, Ala. 35758

[21] Appl. No.: 823,996

[22] Filed: Aug. 12, 1977

[51] Int. Cl.[2] ..... F41C 27/00
[52] U.S. Cl. ..... 42/51; 42/83
[58] Field of Search ..... 42/51, 83, 69 R

[56] References Cited

U.S. PATENT DOCUMENTS 3,780,464 12/1973 Anderson ..... 42/51

*Primary Examiner*—Charles T. Jordan
*Attorney, Agent, or Firm*—C. A. Phillips

[57] ABSTRACT

A muzzle loading firearm in which firing is effected by a shot shell primer positioned within an ignition chamber.

2 Claims, 5 Drawing Figures

MUZZLE LOADING FIREARM

BACKGROUND OF THE INVENTION

1. Field of the Invention

This invention relates to muzzle loading firearms, and particularly to a firing system for such firearms.

2. General Description of the Prior Art

Heretofore, and perhaps for over a hundred years, muzzle loading firearms have been fired or ignited by means of a percussion cap 80 (FIG. 5). Percussion cap 80 has a slightly tapered case 82 with a closed (smaller) end 84 and an explosive charge 86 which is positioned within case 82 adjacent to end 84. The opposite end 88 is open and is adapted to fit over a tubular holder 90 (in turn adapted to be screwed into the breech end of the barrel of a firearm) having an opening 91 which connects with the interior of the barrel of the firearm. Percussion cap 80 is fired by hammer 92 by simply compressing charge 86 between closed end 84 of the percussion cap and the top surface of holder 90. The resulting flame is then directed through opening 91 to the interior of the barrel of the rifle to fire a propellant therein. It is well known that the percussion cap system is not highly reliable and that misfires not infrequently occur. A further difficulty is that a part of the explosion can leak out between the wall of case 82 and holder 90, and it is necessary to provide a shroud 94 on hammer 92 to provide a measure of protection for the user of the firearm.

Accordingly, it is the object of this invention to provide an improved muzzle loading firearm wherein the reliability problem and danger with the percussion cap system of firing are eliminated.

SUMMARY OF THE INVENTION

In accordance with this invention, a muzzle loading firearm is equipped with a tubular ignition chamber in place of a percussion cap holder, and this chamber is formed in a tubular member which screws into an opening in the breech of the firearm. The tubular member includes an opening which extends from end to end and cooperates with the opening in the breech of the firearm. As attached, the outer end of the opening in the tubular member is enlarged to accept the barrel of a shot shell primer, and an outer planar surface of the tubular member supports the flanged end of the shot shell primer. The cup-shaped striking end of the hammer of the firearm is eliminated, and the hammer employs only a small protrusion on the end of the hammer which strikes a centrally located membrane on the flanged end of the shot shell primer. Since the explosive of the shot shell primer is contained with both the tubular member of the shot shell primer and the chamber in which it is positioned, its explosive force is directed solely into the interior of the barrel of the firearm to reliably and safely fire it.

DETAILED DESCRIPTION OF THE DRAWINGS

Figure 2:
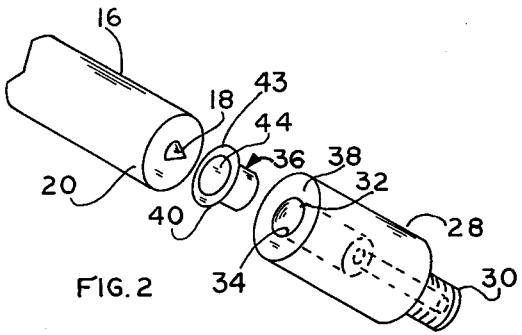
FIG. 2 is an exploded pictorial view showing basic elements of the ignition system.

Muzzle loading forearm 10 has a conventional barre 12 and trigger assembly 14 for cocking and releasin hammer assembly 16. Hammer assembly 16 includes pointed protrusion 18 positioned on hammer 20. Ther is an opening 22 between the exterior 23 and interior (o bore) 24 of barrel 12, opening 22 having a threade region 26 into which is threaded and thereby attache igniter barrel 28, attachment being by means of exter nally threaded end region 30. Igniter barrel 28 include an opening 32 which communicates with opening 22 o firearm barrel 12, and opening 32 has an enlarged regio 34 (FIG. 2) adapted to conform to the outside diamete of a conventional shot shell primer 36. The top or out side end surface 38 of igniter barrel 28 is planar, lying i a plane generally perpendicular to opening 32, and thu shot shell primer 36 is positionable, for firing, withi enlarged region 34 with flange 40 of the primer sup ported by end suface 38 of igniter barrel 28.

Shot shell primer 36 contains an explosive 42 in en gagement with a thin metal membrane 44, centrall positioned in an end closure 43 of shot shell primer 36 interior of flange 40 of the closure.

Figure 3:
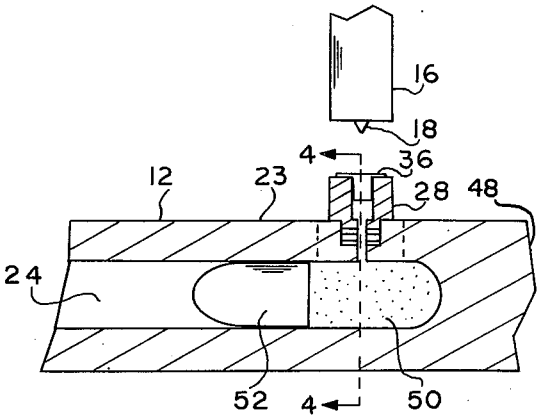
FIG. 3 is a sectional view along lines 3—3 of FIG. 1 and showing in exploded form certain elements of the firing system.
Figure 4:
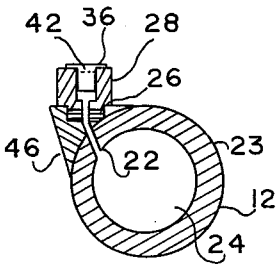
FIG. 4 is a sectional view along lines 4—4 of FIG. 3.
Figure 5:
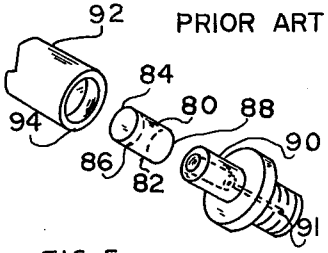
FIG. 5 is an exploded view illustrating prior art.

Opening 22 extends diagonally upward from bore 2 through an enlarged side wall portion 46 of the barrel as shown in FIG. 4. Typically, the bottom end of open ing 22 enters bore 24 near breech end 48 of the barre where an explosive charge 50 would be ignitabl through the opening to fire a projectile 52. Opening 22 of course, communicates with opening 32, and the com bined opening generally extends in a direction norma to bore 24.

Figure 1:
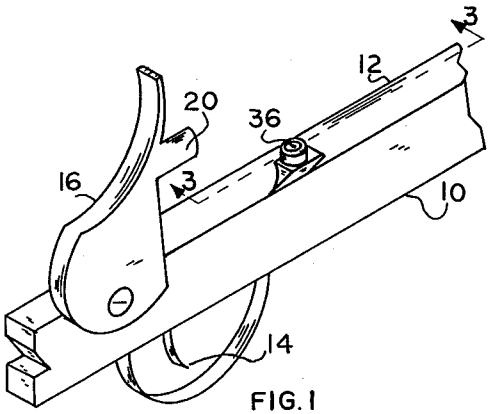
FIG. 1 is a pictorial view of a portion of the breech of a muzzle loading firearm employing the ignition or firing system of the present invention.

To effect firing, shot shell primer 36 is positioned i enlarged region 34 of igniter barrel 28, and with ham mer assembly 16 cocked as shown in FIG. 1, trigger 1 would be pulled, causing hammer assembly 16 to mov clockwise, in turn causing protrusion 18 on hammer 2 to strike membrane 44 of shot shell primer 36. Thi causes explosive 42 to ignite, directing a flame down ward through opening 22 to thereby fire explosiv charge 50 in barrel 12. As will be noted, in contrast to a explosion being external to an opening 22 or 32, whic would have been the case with a percussion cap-type firing device, the igniting explosion is completely con tained, enabling a most reliable and safe firing of firearm 10.

Having thus described my invention, what is claimed is:

1. A muzzle loading firearm comprising:

a firearm barrel having a breech region throug which there is an opening running from exterior t interior of the barrel, and the interior wall of a least an outer end region of said opening being threaded;

an elongated tube having;

an opening extending longitudinally through said tube, said opening being circular and enlarged i diameter in a first end region when compared with the inner diameter of the opposite, or second, end region of said opening, said tube terminating in a plane surface at one end adjacent to said first end region, which plane surface lies generally normal to the direction o said opening, and the outside region adjacent to the opposite, or second, end of said tube being of smaller diameter than said first-named end of said tube, and having an external thread adapted to mate with said interior threaded opening in said barrel;

a shot shell primer comprising:

a tubular body having an outer diameter corresponding to the inner diameter of said first end region of said elongated tube, an explosive charge contained within said tubular body, a generally flat, circular end member closing one end of said tubular body and extending radially outward from said tubular body to form a flange, and said end member including a central membrane adapted to communicate a firing force to said explosive charge when struck, and said tubular body is positioned within said first end region of said elongated tube with said flange resting against said plane surface of said elongated tube; and spring loaded hammer means supported by said barrel, and including a protrusion for applying a small area force to said central membrane of said shot shell primer;

whereby, when operated, said hammer means provides a force which is communicated through said membrane to ignite said explosive charge within said elongated tube, which tube in turn effectively provides a single exit path for the ignited explosive to the interior of the breech of the barrel, enabling a projectile propellant therein to be reliably fired.

2. A firearm as set forth in claim 1 wherein said openings extend in a direction generally normal to the bore of said barrel.

* * * * *